United States Patent [19]

Laserson et al.

[11] 4,084,870

[45] Apr. 18, 1978

[54] MINIATURE MATRIX PROGRAMMING BOARD

[75] Inventors: Gregory L. Laserson, Scarsdale; Miklos Madarasz, Harrison, both of N.Y.

[73] Assignee: Sealectro Corporation, Mamaroneck, N.Y.

[21] Appl. No.: 451,213

[22] Filed: Mar. 14, 1974

[51] Int. Cl.[2] ..... H01R 13/12

[52] U.S. Cl. ..... 339/18 P; 339/147 P; 339/256 R

[58] Field of Search ..... 339/18, 147, 198 R, 339/198 G, 198 GA, 198 H, 183, 256

[56] References Cited

U.S. PATENT DOCUMENTS

| | | | |
|---|---|---|---|
| 1,951,168 | 3/1934 | Roth | 339/198 R X |
| 2,912,666 | 11/1959 | Hurvitz | 339/198 H X |
| 3,065,439 | 11/1962 | Krause | 339/18 C |
| 3,145,329 | 8/1964 | Deakin et al. | 339/183 X |
| 3,175,179 | 3/1965 | Trump | 339/18 C |
| 3,205,469 | 9/1965 | Frank et al. | 339/18 C |
| 3,350,676 | 10/1967 | McFadden | 339/256 R X |
| 3,373,398 | 3/1968 | Volinskie | 339/198 GA X |
| 3,439,315 | 4/1969 | Hamel et al. | 339/256 R X |
| 3,868,163 | 2/1975 | Jarosek | 339/256 R X |

FOREIGN PATENT DOCUMENTS

| | | | |
|---|---|---|---|
| 2,006,553 | 12/1969 | France | 339/183 |
| 6,604,460 | 10/1966 | Netherlands | 339/18 B |
| 866,081 | 4/1961 | United Kingdom | 339/18 C |

*Primary Examiner*—Joseph H. McGlynn
*Attorney, Agent, or Firm*—Anthony J. Casella

[57] ABSTRACT

An enclosed matrix programming board or connecting means for joining two circuits includes connecting bars formed with split, cylindrical sockets for each connecting position and held in place by an insulator block formed with a hole for each connecting socket. Connecting pins are applied through a perforated cover plate and join a conductive bar placed in one position with a similar bar orthogonal to it. Each bar is connected to a pin extending a short distance from one of the cover plates for connection to an exterior circuit. Double connector pins, containing a diode in the handle, may be used to restrict the connecting current to one direction only. Parallel ribs are provided on the cover plates for mechanically and electrically isolating the connecting bars.

8 Claims, 10 Drawing Figures

MINIATURE MATRIX PROGRAMMING BOARD

BACKGROUND OF THE INVENTION

There are many cases, particularly in communication and computer circuits, where a large number of conductors from one source of supply is to be connected to another array of conductors leading to other or output circuits. There are many times when such connections may be changed and reconnected to fit another pattern. This is often the case in the telephone circuits where the receiver set must be reconnected in conformity with new receiver locations. A convenient means of changing the contact array is the matrix or cross bar switch described herein. One series of conductors is connected to one set of parallel cross bars, the other series of conductors being connected to the other set of cross bars positioned at right angles to the first set. When no connecting pins are used there is no connection between any of the conductor sets. Any one of the conductors in one set can be joined to any one of the conductors in the other set by inserting a connecting pin in the proper hole. If desired one conductor from one set may be connected to all the conductors in the other set by inserting connecting pins in all the holes in one line in the cover plate. Change of connections is made by merely relocating a connecting pin.

The size of a given matrix board is determined by the spacing between contacts. The industry's trend towards miniaturization makes it necessary to reduce the contact spacing to a minimum consistent with reliable operation. The latter requirement implies the need for very accurate alignment between the corresponding contacts of the upper and lower layers respectively, so that the contact pins, when inserted, provide a low resistance electrical path. Furthermore, each contact must exert a reproducible and consistent contact peressure on the contact pin, regardless of how many pins are inserted in a given row of contacts.

Existing matrix boards having contact spacings of less than ¼ inch do not meet the above criteria in one or more respects. Their design does not insure accurate alignment and/or the contact pressure is dependent upon the number of pins inserted in a row.

Accordingly, it is an object of the present invention to provide a miniaturized, matrix programming board to overcome the shortcomings of the prior art, and achieve, by its features, the desired end result.

A further feature of the present invention is a pair of cover plates which protect the cross bars and which form a mechanical guide means for the contacting pins, as well as electrically separating said cross bars.

Another feature of the invention is the cylindrical, split, contact socket positioned under each contact position for forming a dependable electrical contact between the cross bar and the contacting pin.

Still another feature of the invention is the ability to insert a semiconductor diode between the connected cross bars to restrict the passage of current to one direction.

SUBJECT OF THE INVENTION

The invention comprises a matrix connector including an insulator block formed with a plurality of cylindrical holes in spaced relation and connecting two plane surfaces. The holes are arranged in two sets of lines perpendicular to each other. A first set of conductive bars is positioned in parallel array, each bar formed with a plurality of connecting cylindrical sockets, each socket placed in one end of a hole in the insulator block, a second set of conductive bars is also arranged in parallel array but perpendicular to the first set, each bar in the second set also formed with a plurality of connecting cylindrical sockets, each socket placed in the other end of a hole in the insulator block. A first cover plate is secured to one side of the insulator block for covering one set of cross bars, this cover plate formed with a plurality of holes in alignment with the holes in the insulator block for the insertion of connecting pins. A second cover plate is secured to the other side of the insulator block for covering the other set of cross bars, the second plate containing a plurality of conductive pins, each connected to a cross bar, and extending beyond the surface of the cover plate for connection to an external circuit.

In the subject matrix connector, the contact spacing may be 0.100 inches. This provides for minimum size consistent with the ability to insert and extract contact pins without special tools. The upper and lower layer contacts are held in a one-piece molded structure of electrically insulating material in such a manner that each pair of corresponding upper and lower contacts is located in a single molded hole in said structure, thus insuring absolutely accurate alignment. The contacts are held in the alignment structure by upper and lower cover plates, of electrically insulating material, which are provided with integrally molded ribs so located as to insure proper mechanical and electrical separation of adjacent contacts.

The contacts themselves are designed to achieve consistent and constant pressure on the contact pins. Each contact is in the shape of a cylindrical tube with an axial slit along its length. When a contact pin is inserted, the tube expands slightly, exerting pressure on the pin by virtue of the elastic behavior of the contact material. This pressure is a function of the individual contact only, and is unaffected by the action of adjacent contacts. Furthermore, the inside of each contact tube is provided with three inwardly projecting dimples spaced circumferentially at equal intervals. Thus three separate and redundant electrical contacts are made wherever a contact pin is inserted in the contact providing great contact reliability.

Since the position of each contact is determined by the location of a hole in the supporting structure, it is necessary to insure that the electrically interconnected contacts forming one row can align themselves with the holes of that row. To this end, the interconnection between the contacts is formed of electrically conducting material which is corrugated in such a manner as to permit longitudinal expansion or contraction within the elastic behavior of the material. Thus each individual contact can align itself independently with its corresponding hole in the supporting structure.

Although matrix boards of any size and number of contacts may be built in accordance with the above described design features, the basic unit of the present design consist of 100 programming points arranged in a 10 × 10 matrix. Each such modular unit is equipped with mounting holes through which fasteners may be inserted for individually mounting such units to a base plate, such as a printed circuit board. The 0.100 inch spacing between contacts is designed to match the standard spacing between holes in a printed circuit board to facilitate electrical interconnection. The bottom cover plate of the matrix connector is equipped with three short projections which generate a space between the bottom of the matrix board and the printed circuit board onto which it is mounted. This space is essential to permit proper cleaning of the printed circuit board after soldering.

Since it is often necessary to build matrix boards larger than the 10 × 10 array of the basic module, means have been provided to accomplish this. Each module is equipped with two dovetail grooves, one on each side, which fit specially designed extruded aluminum rails. By means of these rails and matching, flanged aluminum frame members, any number of 10 × 10 modules can be assembled into a larger array.

Additional details of the invention will be disclosed in the following description, taken in connection with the accompanying drawings.

DESCRIPTION OF THE PREFERRED EMBODIMENT

Figure 3:
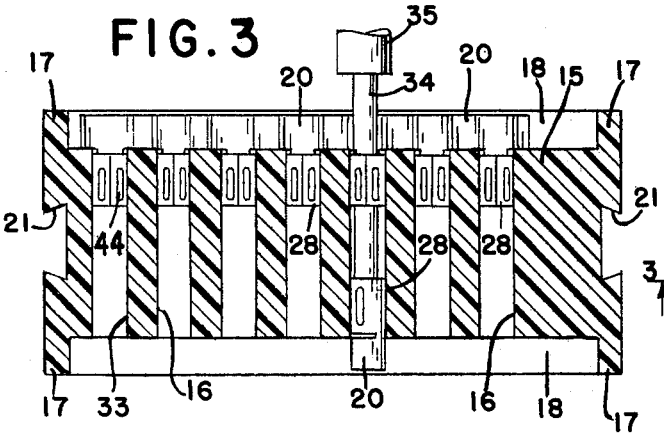
FIG. 3 is a cross sectional view of the insulator block shown in FIG. 4 and is taken along line 3—3 of that figure. This view shows one of the first set of cross bars, one of the second set, and a single connecting pin.
Figure 4:
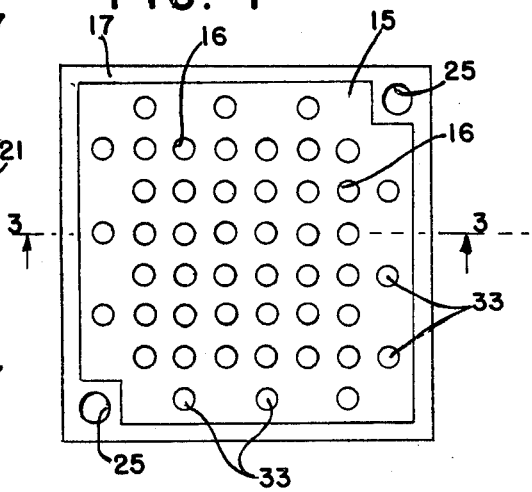
FIG. 4 is a plan view of the insulator block showing the plurality of holes for housing the sockets.

Referring now to the figures, the matrix or cross bar connector of the subject invention comprises a central insulator block 15 (shown in FIGS. 1, 3 and 4) that is formed with a plurality of holes 16 which extend through the block, open at each end. At both the upper and lower sides of the block there is an edge flange 17 forming a shallow recess 18 for containing the cross bars 20 (FIG. 3). The cross bar connectors are generally made with at least 10 holes per side, resulting in 100 holes total. In the figures a six sided array is shown, resulting in 36 holes, to increase the clarity of the description.

Figure 1:
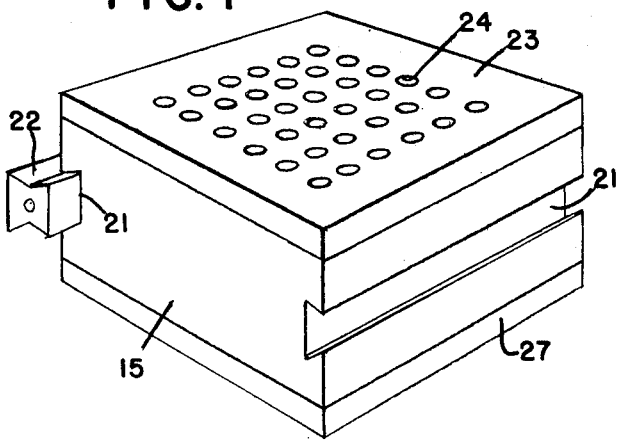
FIG. 1 is a perspective view of the matrix connector showing the two cover plates in place.

The insulator block 15 may be mounted in association with many more similar blocks and to facilitate the assembly and adjustment of the blocks, dovetailed slots 21 are formed in opposite sides of the block, as shown in FIGS. 1 and 3. These slots 21 fit over supporting rods 22 when mounted in an operating circuit.

An upper cover plate 23 is placed over one side of the insulator block 15 for protecting the bars and for guiding the connecting pins to their proper sockets. For this reason guide holes 24 are formed in the upper plate in alignment with the holes in the block. In order to align the holes in the cover plate with the holes in the block, two recessed cavities 25 are formed in the insulator block and two corresponding dowel pins 26 are formed on the underside of the upper cover plate 23. Since conductive sockets are placed in the holes 16 of the conductive block 15 and the connecting pins must pass into the inside of the socket cylinders, the holes in the upper cover place 23 are smaller than the holes in the block 15.

Figure 5:
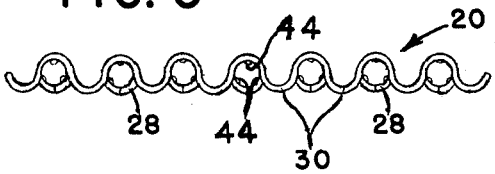
FIG. 5 is a top view of one of the cross bars showing the sockets formed integral therewith.
Figure 6:
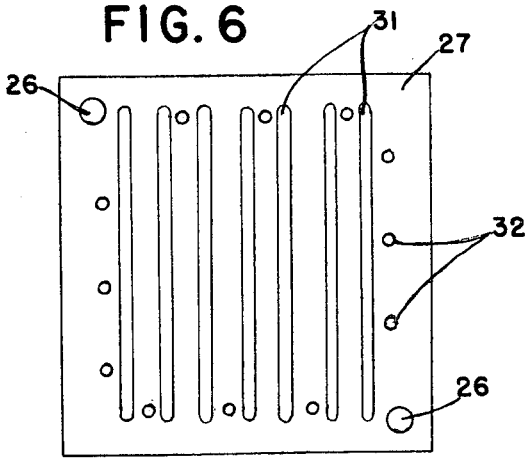
FIG. 6 is a plan view of the second cover plate showing the ribs and the holes for the connecting pins.

Connecting bars 20 are placed in the shallow recesses 18 below the upper cover plate and above the lower cover plate 27. The bars 20 and their connecting sockets 28 are formed from a single sheet of metal, preferably a suitable copper alloy, such as CDA 725 or beryllium copper. To facilitate insertion into the holes 16 and to add flexibility to the bars 20, they are corrugated as shown in FIG. 5, having arcuate bends 30. The bars 20 are held in place by a series of parallel ribs 31 formed on the inside surface of each cover plate 23, 27. The ribs 31 may be formed integral with cover plates 23, 27.

Figure 2:
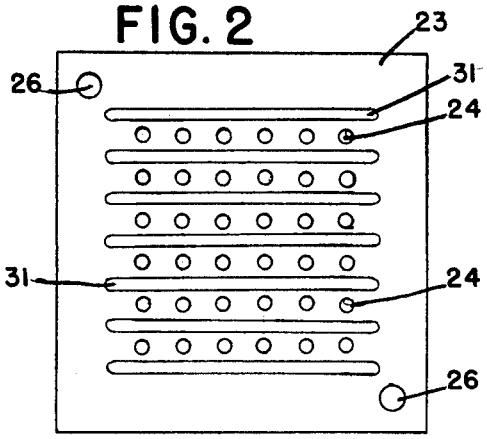
FIG. 2 is a plan view of the first cover plate showing its underside with parallel ribs.
Figure 10:
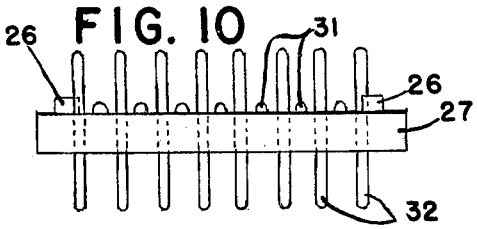
FIG. 10 is a side view of the second cover plate showing the connecting pins for connection to an external circuit.

The upper side of the connector, as shown in FIG. 1, is reserved for the use of removable connecting pins. The lower side is reserved for conductive pins 32 permanently or removably secured in the lower cover plate 27 and extending from the surface of the plate on both sides (see FIG. 10). The upper ends of pins 32 make contact with a bar socket 28 and the lower ends are for any convenient means of connection to an exterior circuit. Also, for convenience, pins 32 may be placed at alternate ends of the cross bars. The edge holes 33 in the insulator block (FIGS. 2 and 4) receive and hold the sockets for pins 32.

Figure 7:
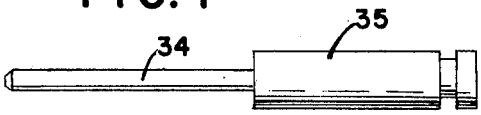
FIG. 7 is a side view of one of the connecting pins showing a conducting pin secured to an insulator handle.
Figure 8:
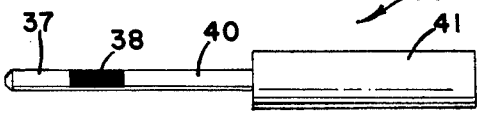
FIG. 8 is a side view of a diode connecting pin having two conductive cylinders separated by an insulator and an insulator handle.
Figure 9:
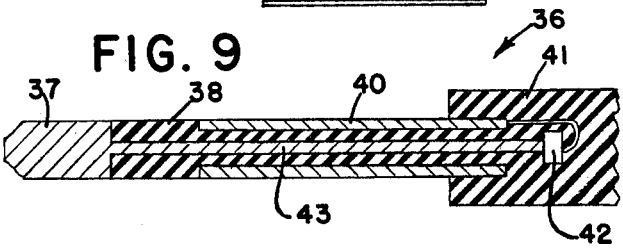
FIG. 9 is a cross sectional view of the pin shown in FIG. 8 and is taken along a median plane of that figure.

FIG. 7 shows a side view of a removable connecting pin 34 with insulated handle 35. The insertion of one of these pins through a hole 24 in cover plate 23 and into contact with two sockets 28, joins two cross bars and thereby connects two external pins 32 with each other. FIGS. 8 and 9 respectively show a side view and cross section of a diode pin 36 comprising a conductive tip 37, an insulated portion 38, a conductive sleeve 40, and an insulated handle 41. A semiconductor diode 42 is positioned within the handle and its terminals are connected to the sleeve 40 and an axial rod 43 which is an integral part of the tip 37. When this diode type of pin is fully inserted into the connector block, the tip 37 is in a lower socket, the sleeve 40 is in one of the upper sockets and two cross bars are connected to each other in series with a diode 42, thereby permitting current to flow only in one direction. Two types of diode pins are provided, one with the diode cathode connected to the tip and the other with the anode connected to the tip. Colored handle ends, such as red and blue are used to indicate polarity.

The sockets 28 are cylindrical in shape and are formed by bending portions of the bar sheet around a cylindrical form when the bars are punched from a flat sheet. Each socket may be formed with one or more elongated inwardly extending dimples or indentations 44 as shown in FIGS. 3 and 5. These dimples make positive contact with the connecting pins 34. As illustrated, each socket 28 is longitudinally split.

The matrix connector of the subject invention provides a new and useful means for interconnecting in matrix fashion a large number of conductor circuits. More particularly, the subject invention provides a miniaturized matrix board with bussed, or in the alternative, individual contacts on 0.100 inch centers, wherein said contacts are held in accurate alignment by the structural members of said board and where each of said contacts provides a uniform contact pressure independent of the action or inaction of any or all of the contacts. In addition, the matrix connector of the subject invention may be designed to have the total of 100 contact points arranged in a 10 × 10 matrix and provided with dovetail grooves which allow the assembly of any number of such boards into an array by interconnecting them with matching aluminum rail and frame members. The cover plates of the matrix connectors retain the contacts and provide mechanical and electrical separation between said contacts by means of ribs integrally molded into the cover plates. The contacts for the matrix connector of the subject invention may consist of cylindrical tubes with axial slits having internal projections so spaced as to provide redundant contact points against a pin inserted into said cylindrical tubes. The contacts may be interconnected by an integral part of a corrugated metallic ribbon, as shown in the drawings, which holds said contacts in proper relative position one to another while permitting adjustment in the center-to-center distance between said contacts in conformance with holes in the insulator block structure of the matrix connector. Still further, the subject matrix connector is equipped with electrical terminations on 0.100 inch centers in order to match the standard spacing of printed circuit boards.

While the invention has been described in connection with a preferred embodiment it will be understood that it is not intended to limit the invention. On the contrary, it is intended to cover all alternative modifications and equivalents as may be included within the spirit and scope of the invention as defined by the appended claims.

The embodiments of the invention in which an exclusive property or privilege is claimed are defined as follows:

1. A matrix connector for selectively connecting a cross bar in a first series of parallel bars with a similar cross bar in a second series of parallel bars comprising:

(a) an insulator block for supporting both series of parallel bars, formed with a plurality of spaced cylindrical holes connecting two plane surfaces and arranged in two orthogonal lines;

(b) a first series of elongated conductive bars in parallel array, each bar in the first series including a strip of conductive material formed with alternate ridges and grooves along its longitudinal axis and including a plurality of depending cylindrical sockets having resilient clamping walls, said sockets positioned in one end of the cylindrical holes in the insulator block;

(c) a second series of elongated conductive bars also in parallel array but perpendicular to the first series, each bar in the second series including a strip of conductive material formed with alternate grooves and ridges along its longitudinal axis and including a plurality of depending cylindrical sockets having resilient clamping walls, said sockets positioned in the other end of the cylindrical holes in the insulator block;

(d) a first cover plate secured to one side of the insulator block for covering one series of cross bars, said cover plate formed with a plurality of holes positioned in alignment with the holes in the insulator block for the insertion of connecting pins;

(e) a second cover plate secured to the other side of the insulator block for covering the second series of cross bars, said cover plate having a plurality of connecting pins removably connected thereto for making contact with a socket in each cross bar and for connection to an external circuit; and, (f) a plurality of conducting connecting pins for insertion through the holes in the first cover plate to make contact with a socket in the first series of bars and a socket in the second series of bars.

2. A matrix connector according to claim 1 wherein said connecting pins are provided with a conductive tip and a conductive sleeve, and a semiconductor diode connected between the tip and sleeve for inserting a diode element between said first and second sets of bars.

3. A matrix connector according to claim 1 wherein said insulator block is formed with two dovetailed slots on either side thereof for multiple storage of connectors on parallel rods.

4. A matrix connector according to claim 1 wherein the insulated block is formed with a shallow recess bordered by a flange at each surface of the block containing the ends of said holes, said recess for positioning the corrugated bars therein.

5. A matrix connector according to claim 1 wherein each of said sockets is formed with inwardly extending dimples for making positive contact with the connecting pins.

6. A matrix connector according to claim 1 wherein said second cover plate is molded of plastic insulator material and permanently secures all of said connecting pins.

7. A matrix connector according to claim 1 wherein said first and second cover plates are formed with ribs on their inside surfaces in alignment with the cross bars for retaining the cross bars in position.

8. A matrix connector according to claim 7 wherein the ribs are disposed in parallel relationship and formed integral with the respective cover plates.

* * * * *